US006690621B2

(12) United States Patent
Porzio

(10) Patent No.: US 6,690,621 B2
(45) Date of Patent: Feb. 10, 2004

(54) ACTIVE HOUSING BROADBAND TONPILZ TRANSDUCER

(75) Inventor: Raymond Porzio, Lafayette, NY (US)

(73) Assignee: Lockheed Martin Corporation

( * ) Notice: Subject to any disclaimer, the term of this patent is extended or adjusted under 35 U.S.C. 154(b) by 0 days.

(21) Appl. No.: 10/182,655

(22) PCT Filed: Jan. 8, 2001

(86) PCT No.: PCT/US01/00491

§ 371 (c)(1),
(2), (4) Date: Mar. 5, 2003

(87) PCT Pub. No.: WO01/50811

PCT Pub. Date: Jul. 12, 2001

(65) Prior Publication Data

US 2003/0235115 A1 Dec. 25, 2003

Related U.S. Application Data

(60) Provisional application No. 60/174,719, filed on Jan. 6, 2000.

(51) Int. Cl.[7] ..... H04R 17/00

(52) U.S. Cl. ..... 367/158

(58) Field of Search ..... 367/142, 155, 367/157, 158; 310/322, 324, 325, 334, 337

(56) References Cited

U.S. PATENT DOCUMENTS

| | | | | |
|---|---|---|---|---|
| 4,072,871 | A | 2/1978 | Wilson | 310/333 |
| 4,779,020 | A | 10/1988 | Konno et al. | 310/325 |
| 4,916,675 | A | 4/1990 | Hoering | 367/153 |
| 4,991,152 | A | 2/1991 | Letiche | 367/158 |
| 5,481,505 | A | 1/1996 | Donald et al. | 367/130 |
| 5,515,342 | A | 5/1996 | Stearns et al. | 367/155 |
| 5,742,561 | A | 4/1998 | Johnson | 367/157 |
| 2002/0159336 | A1 * | 10/2002 | Brown et al. | 367/138 |

* cited by examiner

*Primary Examiner*—Daniel T. Pihulic
(74) *Attorney, Agent, or Firm*—Duane Morris LLP

(57) ABSTRACT

A longitudinal vibrator assembly comprising at least one piezoceramic, magnetostrictive or electrostrictive transducer (130) having a coaxial housing (200*a*, 200*b* or 200*c*) comprised of at least one slotted or complete cylindrical flexural member vibrating in a circumferential or radial direction and excited by a solid state transduction material.

14 Claims, 11 Drawing Sheets

ACTIVE HOUSING BROADBAND TONPILZ TRANSDUCER

RELATED APPLICATION

This application claims priority of U.S. patent application No. 60/174,719, entitled ACTIVE HOUSING BROADBAND TONPILZ TRANSDUCER, filed Jan. 6, 2000, the entire disclosure of which is incorporated by reference herein.

FIELD OF THE INVENTION

The invention in general relates to transducers, and more particularly, to an underwater transducer adapted for low frequency sonar use.

BACKGROUND OF THE INVENTION

A sonar transducer is a device for generating sound and sensing sound in water. A sonar transducer is at heart a resonator which in the case of ceramic sonar transducers, includes an electroded ferroelectric member. The application of electrical potentials to the electrodes excites mechanical motion in the ferroelectric member used to generate sound waves in the water, and mechanical forces exerted upon the ferroelectric member by sound waves in the water is used to generate an electrical potential in the electrodes to sense the sound.

A common form of sonar transducer includes a "stack" of ring shaped drivers, electrically connected in parallel, clamped by means of a stress rod between a tail mass, which is relatively heavy, and a head mass, which constitutes a relatively light, water driving piston. The tail mass, ceramic stack, and head mass form a two mass resonator assembly. The arrangement desirably produces small amplitude vibrations in the tail mass and large amplitude vibrations of the head mass which acts as a water driving piston. This type of transducer is commonly referred to as a "Tonpilz" design transducer or Tonpilz transducer. The Tonpilz transducer assembly is normally housed in an inactive watertight co-axial tube or inactive housing which serves to contain the active Tonpilz assembly and protect it from water intrusion.

Presently there is no known technique to obtain both low frequency (below on kilohertz) and higher 1–5 kHz response other than using parametric techniques which are limited by poor conversion efficiency and beam widths too narrow to be useful for wide area coverage. This is especially important in the areas of transmit transducers and arrays for anti-submarine warfare (ASW), communications and anti-mine warfare for surface, subsurface and air-launched applications as well as geophysical exploration and target simulation, for example. In the oil exploration industry, broadband coherent sources are greatly desired to take over the role of environmentally prohibitive air guns and explosive sources, for example. Greater frequency diversity provided by a single device which has both high and low frequency capability would be of significant benefit to both naval and geophysical applications.

Accordingly, a device that provides co-location of both low-frequency and high frequency or broadband signal processing is highly desired.

SUMMARY OF THE INVENTION

The present invention uses the normally inert housing of the Tonpilz projector to produce useful low frequency sound below the band of the Tonpilz element when used with flexural (flextensional) or slotted cylinder projectors as well as above the band of the Tonpilz element when used with complete cylinders.

The invention permits a relatively small Tonpilz or piston type transducer element to have a powerful and efficient (60–90%) low frequency surveillance transmit capability in addition to the normal tactical band capability normally associated with this type of element. In a preferred embodiment, a magnetostrictive, electrostrictive or piezoelectric driven Tonpilz driver mechanism is located within an active flexural structure such as a wall driven inverse flextensional or slotted cylinder projector (SCP) assembly. The wall driven flextensional or SCP projector provides the low frequency response in a weight-and-size efficient manner and the Tonpilz element makes efficient use of the empty space inside the wall driven flextensional or SCP. Another embodiment involves the use of a complete ceramic cylinder (not slotted) to make up part of the active housing and provide source level capabilities above the band of the Tonpilz element. Due to their higher frequency there placement in relation to head mass is more critical than the low frequency SCP due to diffraction effects.

The present invention is embodied in a longitudinal vibrator assembly comprising at least one piezoceramic, magnetostrictive, or electrostrictive transducer having a coaxial housing comprised of at least one wall driven flextensional, slotted or complete cylindrical flexural member vibrating in a circumferential or radial direction and excited by a solid state transduction material.

An underwater Tonpilz or piston assembly operative in a first longitudinal vibrational frequency mode and comprising an active housing operative for radiating sound at a substantially different frequency from the longitudinal vibrational frequency mode.

A transducer device comprising a Tonpilz element having a vibrating housing actuated by ceramic, magnetostrictive alloy or electrostrictive means, the housing having a flexural or circumferential or radial mode for increasing the effective bandwidth and frequency diversity of the device.

BRIEF DESCRIPTION OF THE DRAWINGS

The advantages, nature, and various additional features of the invention will appear more fully upon consideration of the illustrative embodiments now to be described in detail in connection with accompanying drawings wherein.

It should be understood that the drawings are for purposes of illustrating the concepts of the invention and are not necessarily to scale.

DETAILED DESCRIPTION OF THE INVENTION

Figure 1:
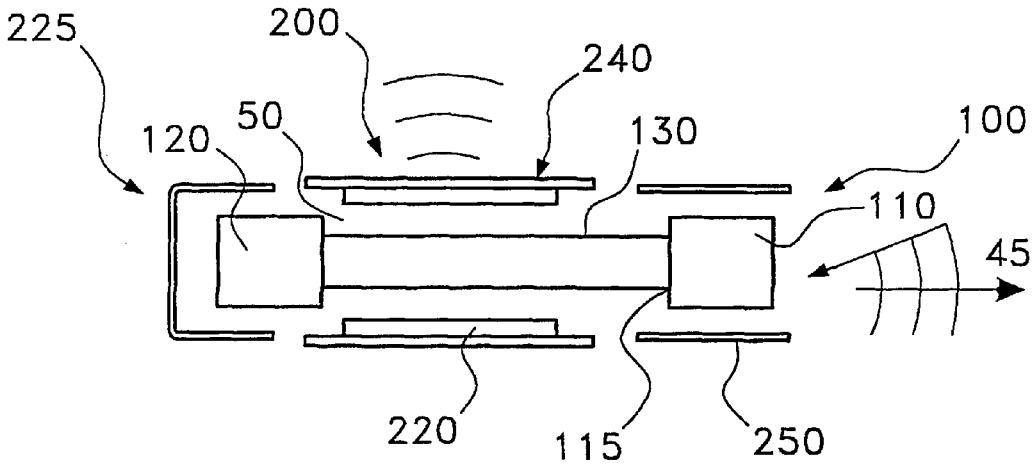
FIG. 1 is a schematic representation of a transducer driver mechanism located within an active slotted cylinder projector assembly according to an embodiment of the present invention.

Referring now to FIG. 1, there is shown a first embodiment of a transducer driver mechanism 100 located within an active slotted cylinder projector assembly 200. The transducer driver mechanism is preferably a magnetostrictive, electrostrictive or piezoelectric driven Tonpilz driver 130 coupled at opposite ends thereof by head mass 110 and tail mass 120 in conventional fashion. The Tonpilz portion of the transducer includes a single ended (as shown in FIG. 1) or double ended projector (having two similar head masses and no tail masses, both head masses being exposed to water) so as to radiate (via the head mass in FIG. 1) in a direction as shown by reference numeral 45. In the low frequency enhancement case, the drive assembly 100 of the Tonpilz section is housed inside coaxial located SCP transducer structure 200 having a resonance frequency below that of the Tonpilz element. The SCP 200 has an upper band frequency edge which grades into the lower band edge of the Tonpilz element. Tonpilz drive assembly 100 is enshrouded in an inactive cylindrical tube section 250 of similar outside diameter as as the outer diameter of the projector 200. An elastomeric waterproofing material is used to cover or fill the interface between the head mass 110 and the cylindrical tube 250 and thereby prevent the intrusion of water into the assembly. The inactive tube section 250 extends from the radiating face 110A a given distance beyond to the junction 115 between the head mass 110 and the longitudinal driver 130. The slotted cylinder 200 is terminated near the rear end cap 225 on the tail mass side 120 of the assembly to provide a means of water proofing the unit. Split cylindrical wall portion 240 radiates in response to stimulus via ceramic transducer elements 220 disposed therein. As previously mentioned, the longitudinal driver may be made of a ceramic, terfenol-D or other electrostrictive, magnetostrictive, piezoceramic or piezomagnetic solid state material. The housing may be formed as a split cylinder (as shown in FIG. 1) or a complete or monolithic (i.e. unsplit) cylinder, wherein an advantage of the split cylinder consists in the attainment of a very low frequency for the size of the transducer structure (e.g. 500 Hz is attainable for a 4–5 inch outer diameter cylinder). In the case of a magnetostrictive longitudinal drive member 130, certain advantages including self-tuning and improved phase transition between the Tonpilz section and the ceramic SCP 200 response are readily exploited. These advantages arise since the impedance of the magnetostrictive Tonpilz element is substantially inductive while that of the SCP is capacitive.

Figure 2:
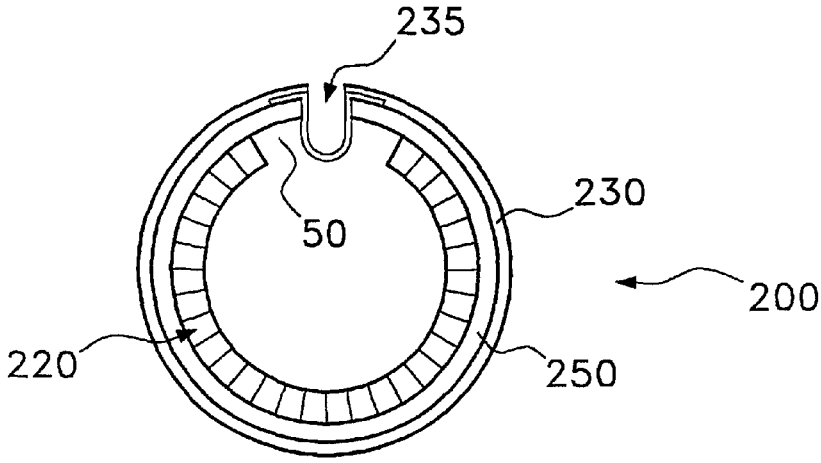
FIG. 2 is a schematic representation of a split cylinder projector.
Figure 3:
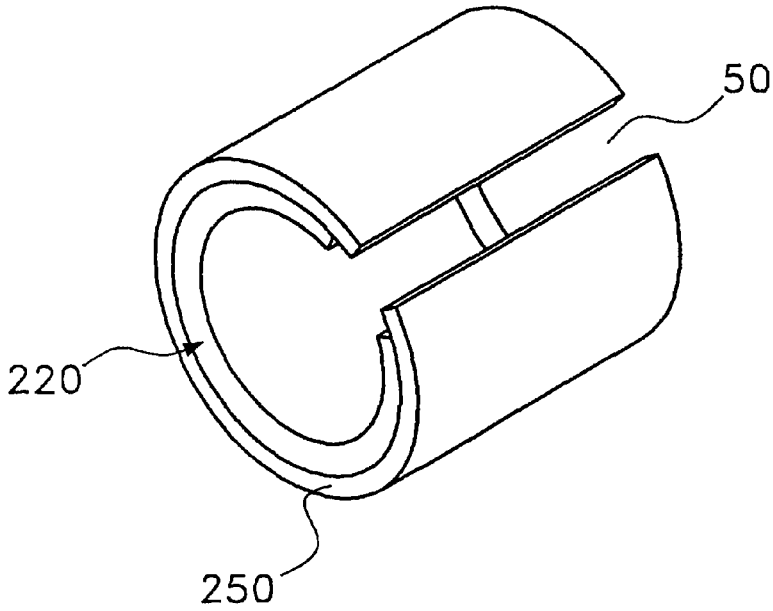
FIG. 3 is a schematic isometric representation of a split cylinder projector shown in FIG. 2.
Figure 4:
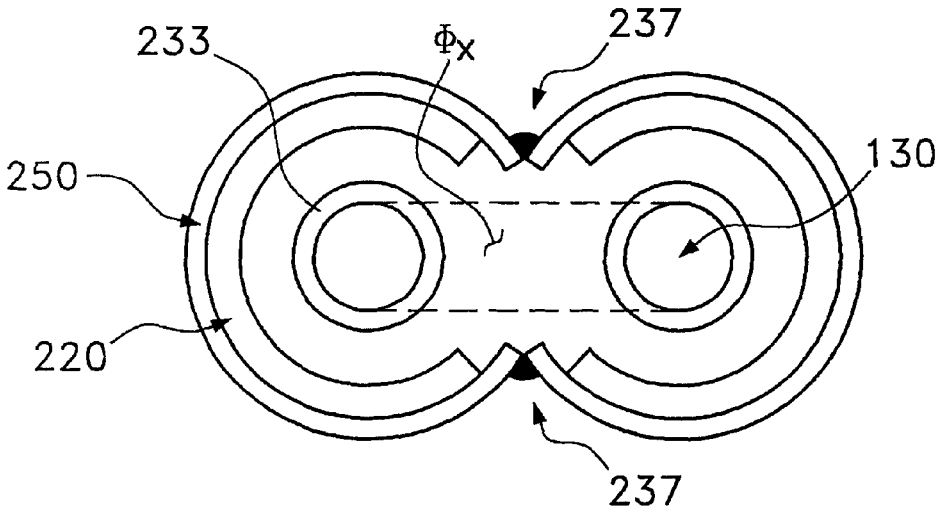
FIG. 4 is a schematic representation of a dual cylinder projection according to an embodiment of the present invention.

FIGS. 2 and 3 show more detailed representations of a split cylinder projector 200 depicted in FIG. 1 which forms a the housing of the Tonpilz element when low frequency enhancement is desired, the housing further including the end cap 225 and inactive tube section 250. As shown in FIG. 2, SCP housing 200 comprises substantially cylindrical section of inert or inactive material 250 surrounding ceramic material 220. Rubber boot 230 is disposed over the inert segment 250 and secured thereto via conventional fastening means. A gap 50 formed between opposite ends of the inactive/inert material 250 is closed via rubber gap seal 235. FIG. 3 depicts an isometric view of the split cylinder illustrated in FIG. 2. Note that the ceramic material 220 may be either in 33 or 31 electric field modes. Note further that gap seal 235 may be eliminated by placing two assemblies side by side and welding together as shown in FIG. 4. This permits a flux path to bridge the gap in the case of a magnetostrictive driver, for example. FIG. 4 illustrates a dual cylinder structure 200' bonded to one another via welds 237 and 238 so as to eliminate the rubber seal in the gap. In this manner, the top flux path is removed and a bottom flux path as shown in FIG. 4 remains, influenced by drive coil 233. The embodiment of FIG. 4 thus utilizes a twin cylinder approach which allows the magnetic circuit of one cylinder's Tonpilz driver to form the magnetic return path with its neighboring driver and also eliminates the requirement for a rubber gap seal as shown in FIG. 2.

Figure 5:
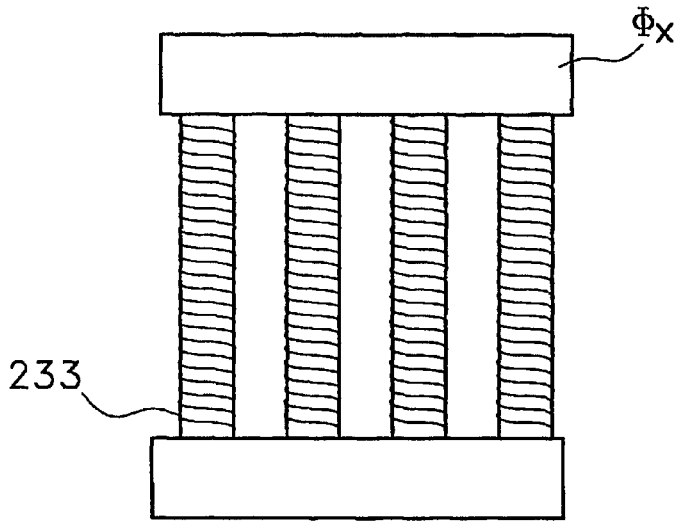
FIG. 5 is a schematic representation of a driver mechanism useful in understanding the present invention.
Figure 6:
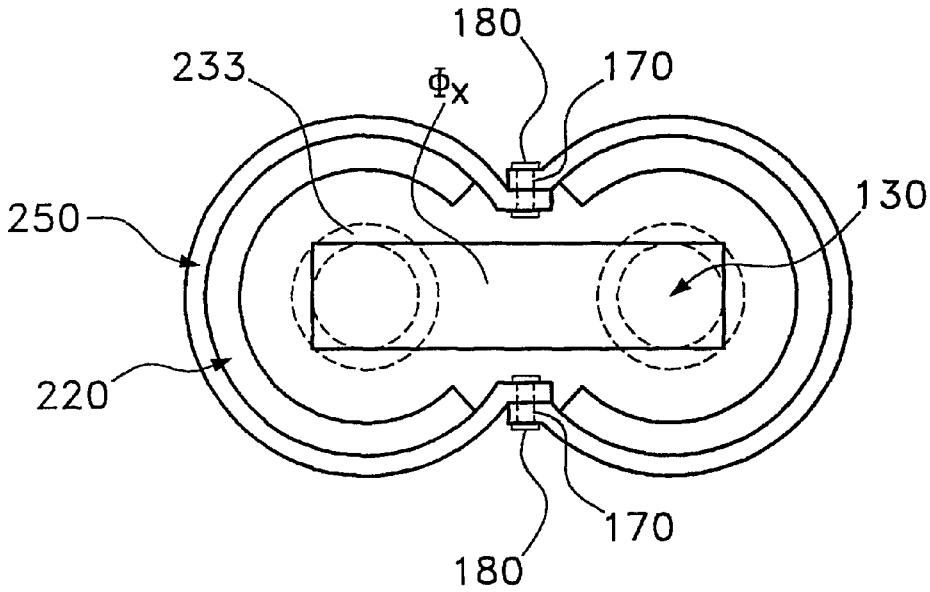
FIG. 6 is a schematic representation of a dual cylinder projector similar to that shown in FIG. 5 according to an embodiment of the present invention.
Figure 7:
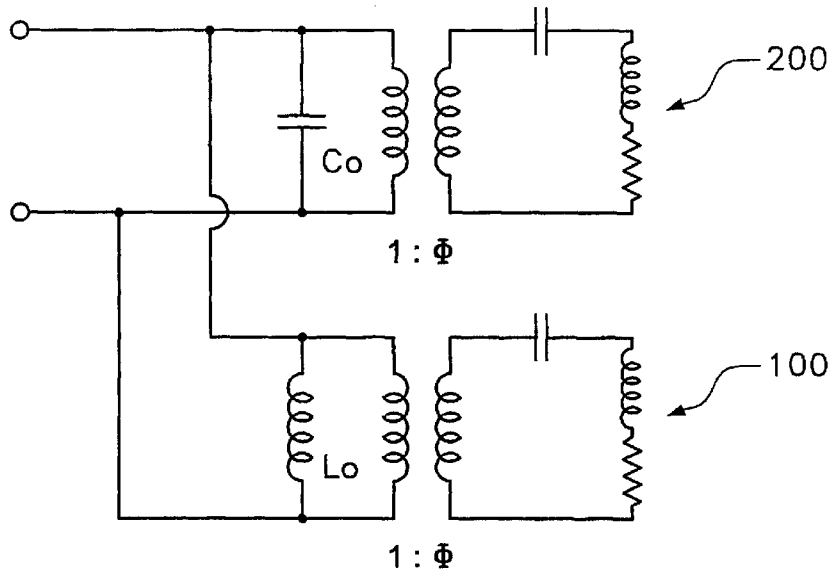
FIG. 7 is a schematic circuit representation of the ceramic cylinder or split cylinder transducer structure and Tonpilz driver structure according to an embodiment of the present invention.

FIG. 5 illustrates a typical dual-legged drive circuit for the magnetostrictive drive embodiment shown in FIG. 4, whereas FIG. 6 shows an alternate means of attaching or fastening the two cylinders together. As shown in FIG. 6, opposite ends of inert layer 250 having through holes 170 overlap one another such that the through holes are in alignment to receive a corresponding fastener 180 such as a bolt, rod, deformable nail, or other such fastening item to secure the structure together. It must be pointed out that a single magnetostrictive stack using a high permeability material for the return path or a single ceramic/electrostrictive stack can be utilized in lieu of the two legged approach shown. Also a two legged drive may be completely enclosed in a single split cylinder shell. FIG. 7 shows an exemplary electrical circuit schematic depicting how the ceramic cylinder or split cylinder transducer structure 200 and the magnetostrictive Tonpilz driver structure 100 have opposite types of blocked reactances which when connected in parallel (or series) provide a degree of self tuning, eliminating in part or in total the need for external tuning electronics.

Figure 8:
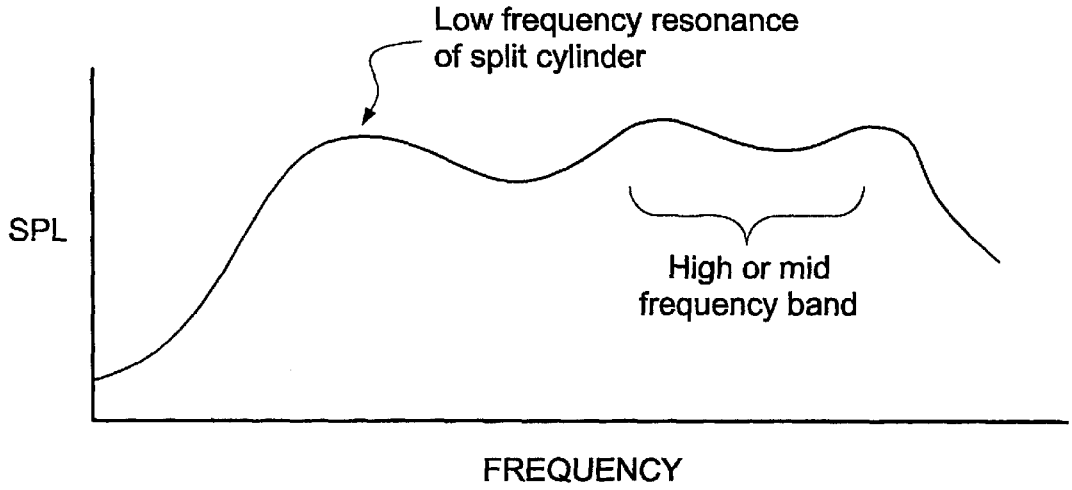
FIG. 8 is a graphical representation of the broadband output of the dual mode transducer according to the present invention.
Figure 9:
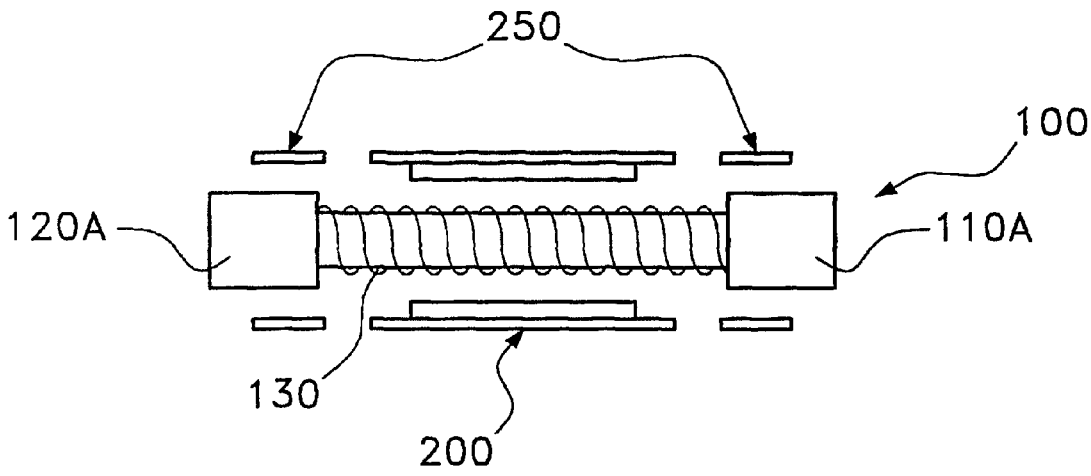
FIG. 9 is a schematic representation of a dual ended transducer driver mechanism located within an active slotted cylinder projector assembly according to an embodiment of the present invention.

FIG. 8 shows how the bandwidth of the Tonpilz element is extended for the flexural response of the split cylinder active housing 200. FIG. 9 shows a double ended single cylinder embodiment according to an aspect of the invention in which sound is radiated out of both ends 110A, 120A. As is understood, the driver 130 may be comprised of any solid state drive material.

Figure 10:
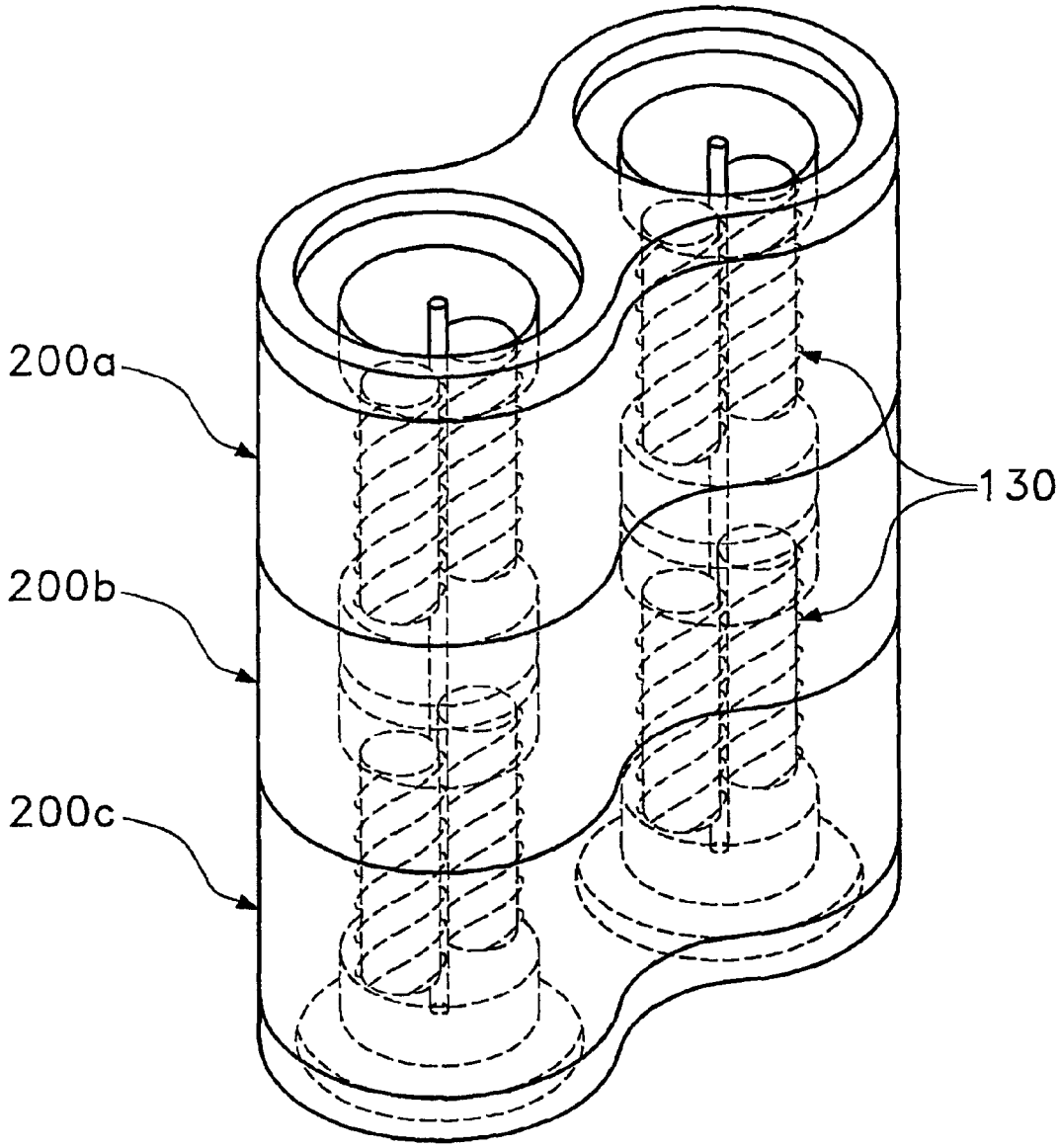
FIG. 10 is a schematic representation of a wall-bone projector in parallel communication with two double ended Tonpilz drivers located within the projector housing according to an embodiment of the present invention.

FIG. 10 shows an embodiment of a transducer device according to the present invention comprising three active housings or shells 200*a*, 200*b*, 200*c* driven in phase and electrically steered to radiate acoustic information. As shown in FIG. 10, dual ended tonpliz driver mechanisms 100 are contained therein. As discussed above, the housing shown in FIG. 10 is in the form of an inverse wall driven flextensional assembly or inverse wall bone structure to produce useful low frequency sound below the band of the Tonpilz element 130 through the excitation of the flexural resonance of the housing. Note that the inverse wall bone structure is inherently broader band and the booted gap in the split cylinder structure is eliminated making the assembly more shock and water tight resistant.

Figure 11:
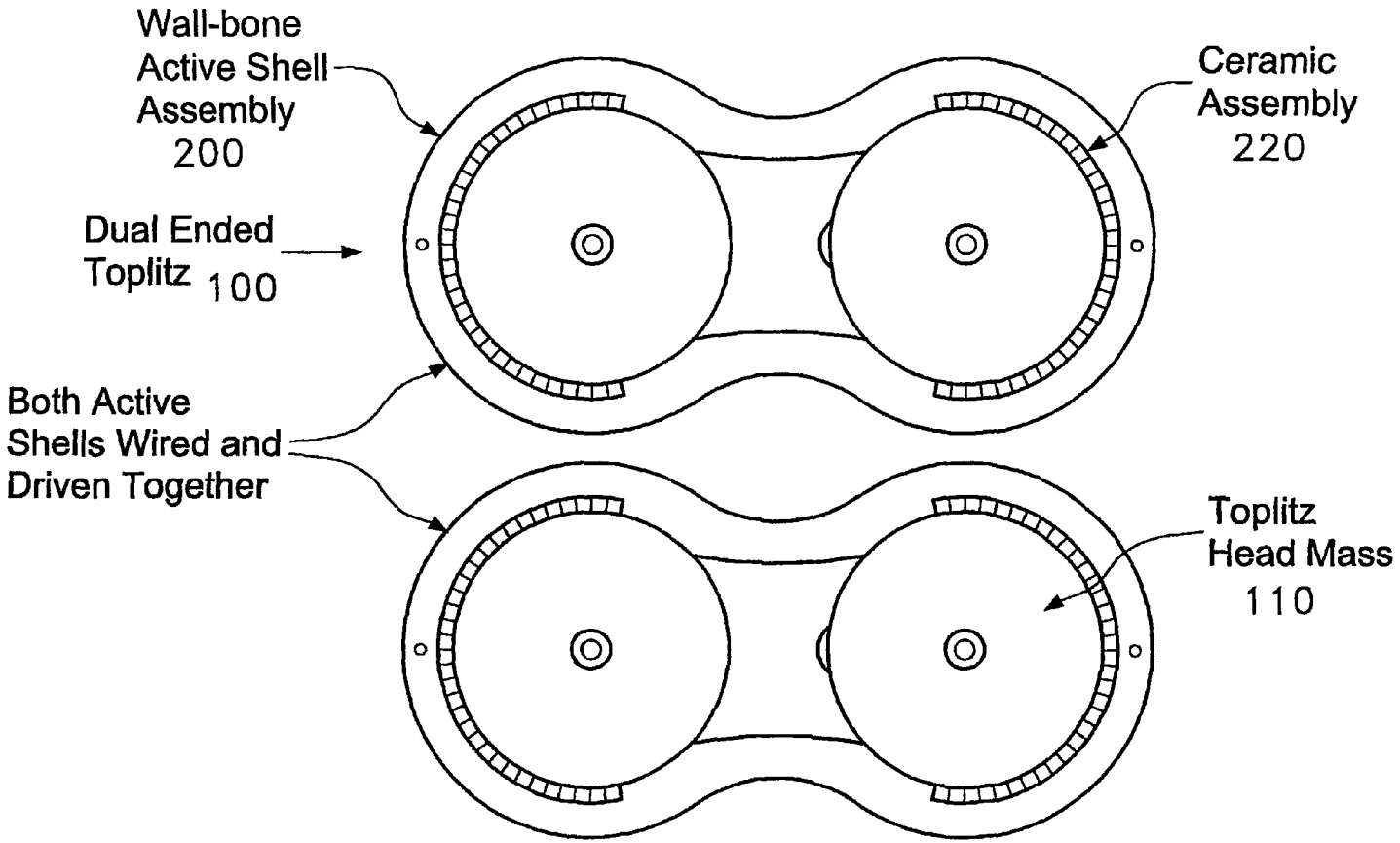
FIG. 11 is a top view schematic of two wall bone transducers shown in FIG. 10.
Figure 12:
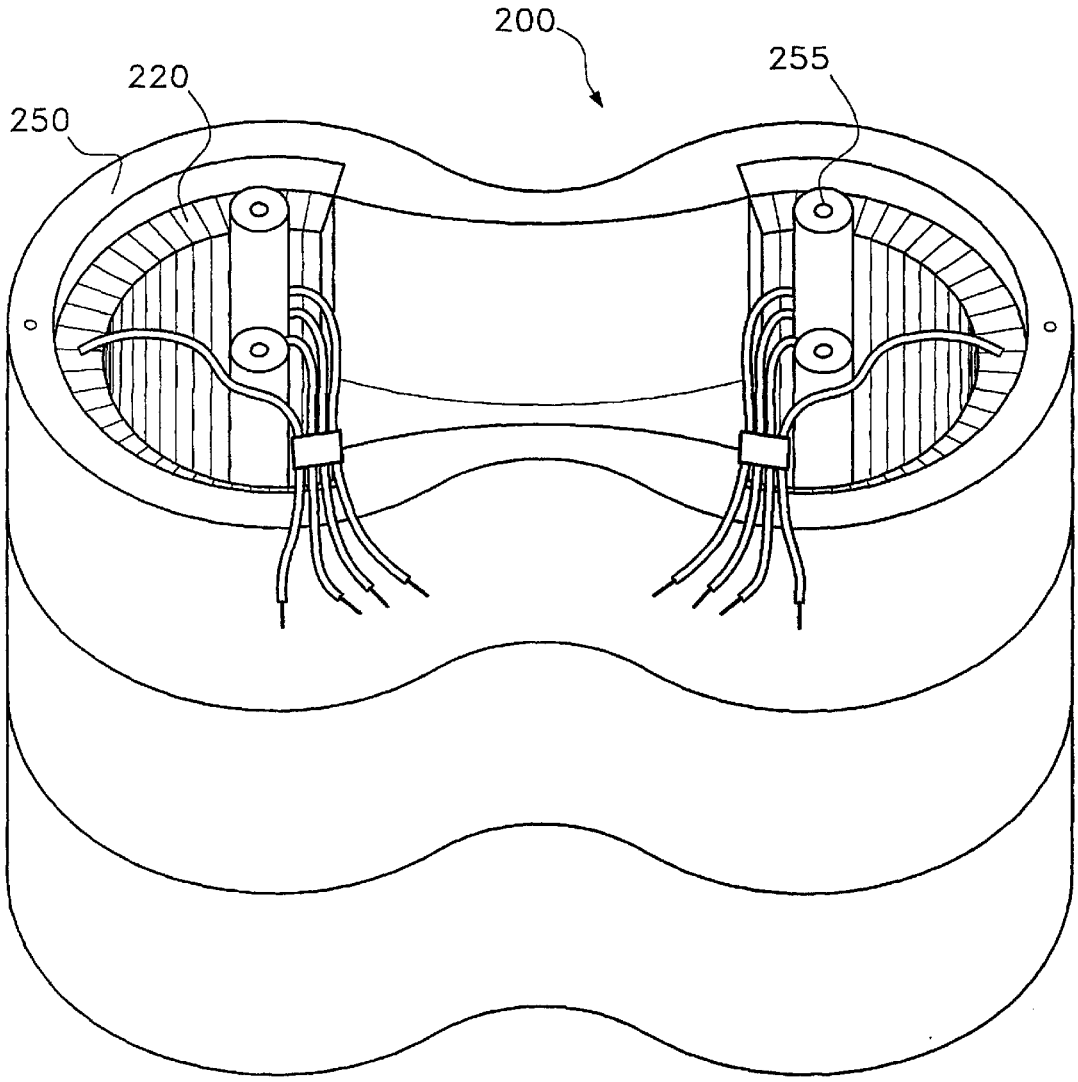
FIG. 12 is a perspective view of a wall bone transducer shown in FIGS. 10 and 11.

FIG. 11 shows a top view of the wall bone transducer structure comprising inert shell portion 250 and ceramic assembly 220 which may be wired and driven to adjacently coupled shell structure 200 and head masses 110. FIG. 12 illustrates a perspective view of the housing 200 with tie rods 255 extending through the structure to provide interconnection and structural integrity. As shown in FIG. 12, the ceramic assembly 220 is electronically connected via wires to provide a vibrating force. The piezoceramic elements are in a substantially U-shaped configuration and separated via a gap 50 such that an electric field is circumferentially applied.

Figure 13:
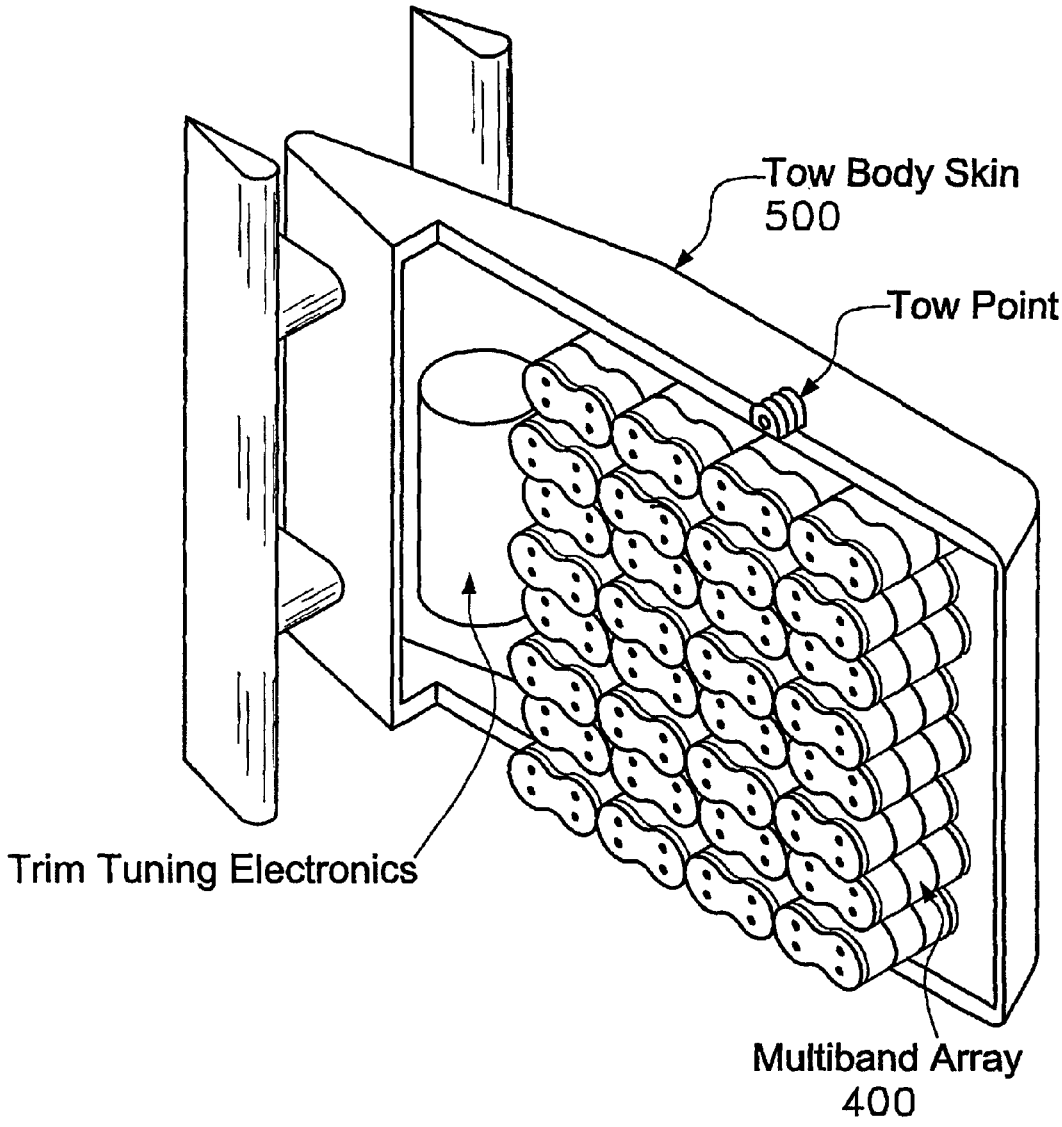
FIG. 13 is a perspective view of a multiband array of Tonpilz transducers within an active housing for use within a towbody.

FIG. 13 provides a series of transducer elements 200 housed within a towbody 500 to form a multiband array structure 400. Trim tuning electronics 600 in electrical communication with the transducers operate to adjust and fine tune the multiband array.

Figure 14:
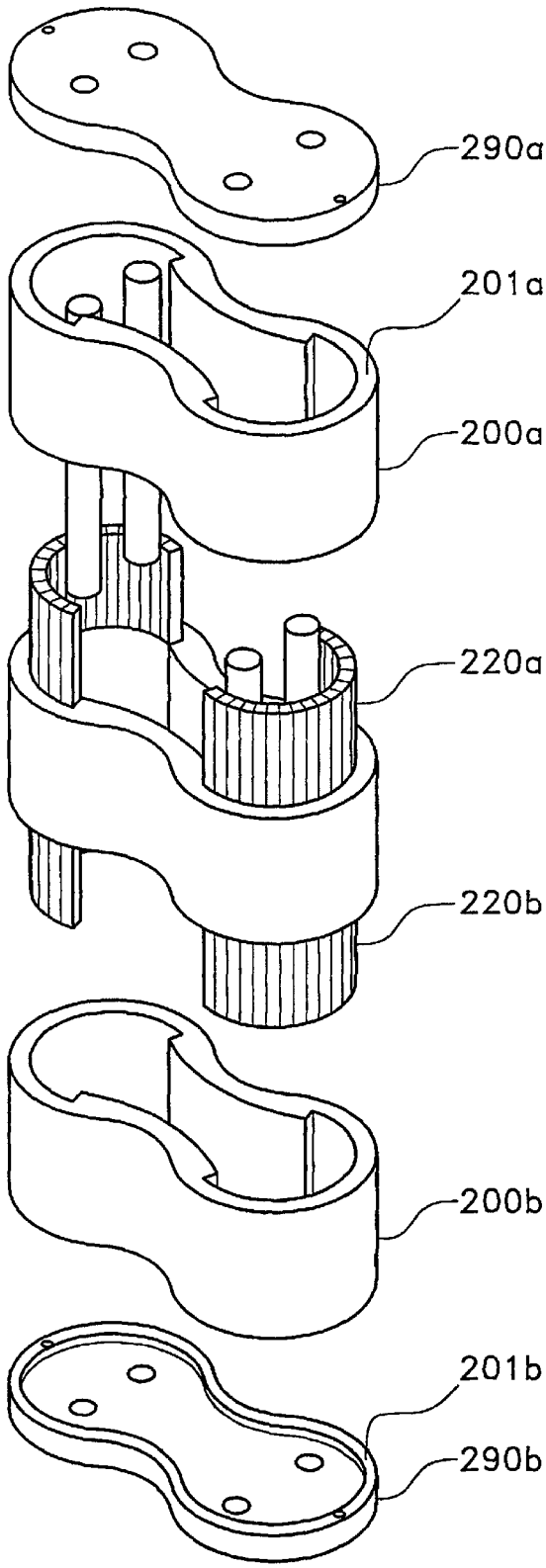
FIG. 14 is an exploded view of the wall bone transducer structure elements according to an aspect of the present invention.
Figure 15:
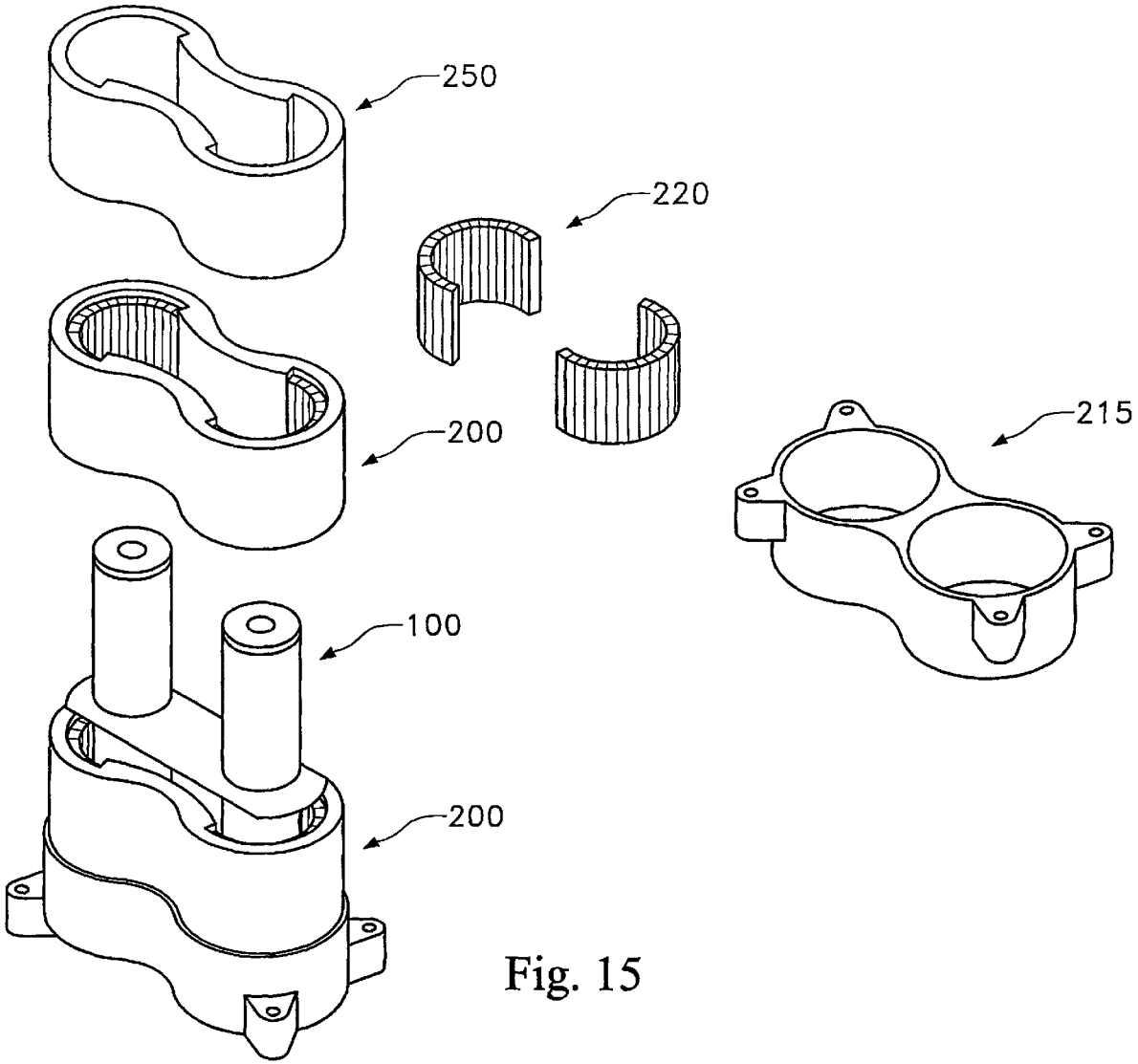
FIG. 15 is an exploded view of an integrated active housing tonpilz projector having a terfenol magnetostrictive Tonpilz driver mechanism formed within the wall bone transducer structure elements according to an aspect of the present invention.

FIG. 14 illustrates an exploded view of a plurality of transducer housings for the Tonpilz elements comprising end caps 290*a* and 290*b* at oppositely disposed end portions which cover respective front surfaces 201*a*, 201*b* of housings 200*a*, 200*b*. Ceramic assembly portions 220*a* and 220*b* are housed within sections 200*a* and 200*b*. The structure is connected via tie rods 255 extending therethrough. FIG. 15 provides an exploded view of a transducer structure according to the present invention in a manner similar to that depicted in FIG. 14 but further including the two Tonpilz driver elements and drive coils formed within the housing 200. End cap/end sleeve 215 provides a means of containment for the head masses. An elastomeric compound covering the exterior interface between the head masses and the end cap/end sleeve's inner diameter provides a means of waterproofing the assembly.

As described herein, embodiments of the present invention have illustrated the concept of a normally inert housing of a Tonpilz element such as the TR-343 transformed into an active projector for the purpose of increased low frequency capability while not reducing the ability of the normal Tonpilz band to perform its function. The short length of wall driven inverse flextensional (wall-bone) or SCP relative to a wave length enables these projectors to radiate effectively without adverse diffraction effects as long as the forward aperture is at least partially open. The concept permits tactical and surveillance arrays to be collocated thereby greatly reducing ship impact. In other words, instead of a tightly packed array, some space between Tonpilz heads is allowed to remain, or circular heads are used to permit the low frequency sound to radiate past the head region. In effect the Tonpilz end masses take the place of the normal end caps on the wall driven inverse flextensional or the SCP. This has little impact on a large array and only slightly reduces the Tonpilz array's resistive loading and resonance frequency.

What is claimed is:

1. An underwater Tonpilz or piston assembly operative in a first longitudinal vibrational mode comprising:

an active housing operative for radiating sound at a substantially different frequency from the longitudinal vibrational mode.

2. The assembly of claim 1, wherein said active housing comprises a ceramic transducer material surrounded by an inert material.

3. The assembly of claim 1, wherein said Tonpilz or piston assembly further comprises a piezoceramic transducer.

4. The assembly of claim 1, wherein said Tonpilz or piston assembly further comprises a magnetostrictive transducer.

5. The assembly of claim 1, wherein said Tonpilz or piston assembly further comprises a electrostrictive transducer.

6. The assembly of claim 1, wherein said active housing comprises an inverse flextensional transducer.

7. The assembly of claim 1, wherein said active housing comprises a slotted cylindrical projector assembly.

8. The assembly of claim 1, wherein said active housing comprises a complete cylindrical projector assembly.

9. A longitudinal vibrator assembly comprising at least one piezoceramic, magnetostrictive or electrostrictive transducer having a coaxial housing comprised of at least one slotted or complete cylindrical flexural member vibrating in a circumferential or radial direction and excited by a solid state transduction material.

10. The vibrator assembly of claim 9, further comprising a plurality of piezoceramic, magnetostrictive or electrostrictive transducers having a coaxial housing comprised of slotted or complete cylindrical flexural members vibrating in a circumferential or radial direction and in electrical communication with one another.

11. The vibrator assembly of claim 9, wherein said at least one transducer comprises a magnetostrictive transducer having a head mass and tail mass.

12. The vibrator assembly of claim 10, further comprising a slotted cylindrical flexural member having a gap formed therein and covered via a sealing material.

13. The vibrator assembly of claim 12, further comprising a plurality of slotted cylinders mounted to one another at said respective gap to permit the passage of magnetic flux between adjacent assemblies.

14. A transducer device comprising a Tonpilz element having a vibrating housing actuated by ceramic, magnetostrictive alloy or electrostrictive means, said housing having a flexural or circumferential or radial mode for increasing the effective bandwidth of the device.

* * * * *